US010784069B2

(12) United States Patent
Tuohimaa et al.

(10) Patent No.: US 10,784,069 B2
(45) Date of Patent: Sep. 22, 2020

(54) STRUCTURED X-RAY TARGET

(71) Applicant: Excillum AB, Kista (SE)

(72) Inventors: Tomi Tuohimaa, Kista (SE); Per Takman, Kista (SE); Andrii Sofiienko, Kista (SE)

(73) Assignee: EXCILLUM AB, Kista (SE)

( * ) Notice: Subject to any disclaimer, the term of this patent is extended or adjusted under 35 U.S.C. 154(b) by 0 days.

(21) Appl. No.: 16/340,449

(22) PCT Filed: Oct. 19, 2017

(86) PCT No.: PCT/EP2017/076770
§ 371 (c)(1),
(2) Date: Apr. 9, 2019

(87) PCT Pub. No.: WO2018/073375
PCT Pub. Date: Apr. 26, 2018

(65) Prior Publication Data

US 2019/0311874 A1 Oct. 10, 2019

(30) Foreign Application Priority Data

Oct. 21, 2016 (EP) ..... 16195035

(51) Int. Cl.
*H01J 35/08* (2006.01)
*H01J 35/30* (2006.01)
(Continued)

(52) U.S. Cl.
CPC ..... *H01J 35/30* (2013.01); *H01J 35/08* (2013.01); *H01J 35/14* (2013.01); *H01J 35/186* (2019.05); *H05G 1/52* (2013.01); *H01J 35/116* (2019.05)

(58) Field of Classification Search
CPC .. H01J 35/30; H01J 35/08; H01J 35/14; H01J 35/116; H01J 35/186; H04G 1/52
See application file for complete search history.

(56) References Cited

U.S. PATENT DOCUMENTS 3,925,660 A * 12/1975 Albert ..... G01N 23/223 378/45
5,602,899 A 2/1997 Larson
(Continued)

FOREIGN PATENT DOCUMENTS

DE 102010009276 A1 8/2011
EP 3093867 A1 11/2016
(Continued)

OTHER PUBLICATIONS

International Search Report (PCT/ISA/210) dated Jan. 31, 2018, by the European Patent Office as the International Searching Authority for International Application No. PCT/EP2017/076770.
(Continued)

*Primary Examiner* — Kiho Kim
(74) *Attorney, Agent, or Firm* — Buchanan Ingersoll & Rooney P.C.

(57) ABSTRACT

A system and method for generating X-ray radiation. The system includes an electron source operable to generate an electron beam and an X-ray target for generating X-ray radiation upon interaction with the electron beam. The method includes moving the electron beam over an edge separating a first region and a second region of the X-ray target, wherein the first region and the second region have different capability to generate X-ray radiation upon interaction with the electron beam. The system allows for a lateral extension of the electron beam to be determined based on a change in a quantity indicative of the interaction between the electron beam and the first region and between the electron beam and the second region, and the movement of the electron beam.

17 Claims, 6 Drawing Sheets

(51) Int. Cl.

| | |
|---|---|
| ***H01J 35/14*** | (2006.01) |
| ***H01J 35/18*** | (2006.01) |
| ***H05G 1/52*** | (2006.01) |

(56) References Cited

U.S. PATENT DOCUMENTS

| | | | |
|---|---|---|---|
| 2009/0067578 | A1 | 3/2009 | Behling et al. |
| 2010/0020938 | A1 | 1/2010 | Koch et al. |
| 2012/0269323 | A1 | 10/2012 | Adler et al. |

FOREIGN PATENT DOCUMENTS

| | | | |
|---|---|---|---|
| JP | 2005332623 | A | 12/2005 |
| JP | 2014225401 | A | 12/2014 |
| WO | 2015125395 | A1 | 8/2015 |

OTHER PUBLICATIONS

Written Opinion (PCT/ISA/237) dated Jan. 31, 2018, by the European Patent Office as the International Searching Authority for International Application No. PCT/EP2017/076770.

International Preliminary Report on Patentability (PCT/IPEA/409) dated Feb. 4, 2019, by the European Patent Office as the International Searching Authority for International Application No. PCT/EP2017/076770.

* cited by examiner

STRUCTURED X-RAY TARGET

TECHNICAL FIELD

The invention disclosed herein generally relates to generation of X-ray radiation. In particular, it relates to an electron-impact X-ray source with a solid target, and a technology for determining a width of the electron beam as it interacts with the target.

TECHNICAL BACKGROUND

X-ray radiation may be generated by letting an electron beam impact upon a solid anode target. The quality of the generated X-ray radiation, such as e.g. spatial distribution and brightness, is determined, inter alia, by the spot size and intensity of the electron beam at the interaction region on the target. The spot size is of particular interest in e.g. imaging applications, in which a reduced spot size may allow for an increased resolution. Further, a relatively high power density of the electron beam is desired for increasing the efficiency of the X-ray source, but needs to be controlled to avoid excessive heating and eventually destruction of the target.

Traditionally, the effective X-ray spot size may be determined by using dedicated calibration charts in an X-ray projection imaging setup.

Even though such technologies may provide methods for determining and controlling properties of the electron beam interacting with the target, there is still a need for improved systems and methods for generating X-rays radiation.

SUMMARY

It is an object of the present invention to provide a system and a method addressing at least some of the above issues. A particular object is to allow for a facilitated and improved control of the interaction between the electron beam and the X-ray target.

This and other objects of the technology disclosed are achieved by means of a system and method having the features defined in the independent claims. Advantageous embodiments are defined in the dependent claims.

Hence, according to a first aspect, there is provided a method in a system comprising an X-ray target, such as a stationary target, and an electron source that is operable to generate an electron beam interacting with the X-ray target. According to the method, the electron beam is directed onto the target and moved or scanned, either continuously or in a stepwise fashion, over an edge separating a first region and a second region of the X-ray target, wherein the first region and the second region have different capability to generate X-ray radiation upon interaction with the electron beam. Further, a quantity is measured, which is indicative of the interaction between the electron beam and the target, and in particular the difference in interaction with the first and second region. The quantity may e.g. be indicative of the amount of generated X-ray radiation, or of an electron transparency of the target. The measured quantity, and in particular a change or variation as a function of position or time of the quantity, is then used for determining a lateral extension of the electron beam. Additionally, a scanning speed or a step length of the electron beam may be used as input for determining the lateral extension.

According to a second aspect, there is provided a system adapted to generate X-ray radiation. The system comprises an X-ray target, such as e.g. a stationary target, having a first region and a second region, and an electron source operable to generate an electron beam interacting with the X-ray target to generate X-ray radiation, wherein the first region and the second region of the target have different capability to generate X-ray radiation. The system further comprises an electron-optical means for controlling the electron beam, and a sensor adapted to measure a quantity indicative of the interaction between the electron beam and the X-ray target. The sensor and the electron-optical means are operably connected to a controller adapted to determine a lateral extension of the electron beam based on the measured quantity received from the sensor as the electron-optical means moves or scans the electron beam over the first region and the second region of the target. The lateral extension may for example be determined based on a variation or time evolution of the measured quantity and/or a scanning speed or step length of the electron beam onto the target.

According to a third aspect, there is provided a system adapted to generate X-ray radiation, which comprises X-ray target, such as e.g. a stationary target, having a first region and a second region, an electron source operable to generate an electron beam interacting with the X-ray target to generate X-ray radiation, an electron-optical means for controlling the electron beam, a sensor adapted to measure a quantity indicative of the interaction between the electron beam and the X-ray target, and a controller operably connected to the sensor and the electron-optical means. The electron-optical means is adapted to direct the electron beam onto the first region and the second region of the X-ray target and move the electron beam spot over an edge separating the first region and the second region. The first and second region of the X-ray target are arranged to provide a contrast of at least two percent in the quantity measured by the sensor, thereby allowing the controller to determine a lateral extension of the electron beam based on the measured contrast. The lateral extension may e.g. be determined along the direction of movement of the electron beam, based on a change in the measured quantity and the movement of the electron beam.

The present invention is based on the realisation that by using a target of two distinct regions in terms of X-ray generating capacity, the difference can be used for extracting information about the electron beam characteristics. The functional difference between the first and second region of the target may also be expressed in terms of electron-impact cross section, electron scattering capability or electron transparency, which may affect the interaction between the electrons and the target material. The material of the first region, which may be adapted to generate the major part of the X-ray radiation, may therefore absorb or scatter more energy and/or electrons of the electron beam than what is absorbed or scattered by the material of the second region. In other words, the different regions of the X-ray target can be said to interact differently with the electron beam generated by the electron source, thereby providing a contrast that can measured. By measuring a quantity indicative of this interaction, or difference in interaction, the contrast between the first and second regions makes it is possible to determine with which one of the regions—and, preferably, to what extent—the electron beam interacts. Further, by scanning or moving the electron beam over an edge or interface defining the two regions, a physical or lateral extension of the electron spot may be determined. By scanning the electron beam in different directions, a symmetry of the electron spot may be verified. Thus, the present aspects provide a methodology wherein the X-ray target per se is used for determining at least one of position and lateral extension (such as width) of the electron spot, and a spatial distribution of the electrons within the electron beam.

The present aspects make it possible to determine with high accuracy whether the electron beam impinges outside the first region, partially inside the first region or completely inside the first region. By deflecting or scanning the electron beam into or out of the first and/or second region while monitoring the quantity indicative of the interaction between the electron beam and the target, and preferably the contrast in the quantity, it is possible to associate a setting of the electron-optical system with a position of the target. Put differently, the position of the electron beam (or rather, of the spot where the electron beam hits the target) may be determined in terms of particular electron-optical system settings. The electron beam may also be scanned over at least a portion of the target, preferably in a set of line scans, to acquire a two-dimensional image of the target. The image may be post-processed and analysed in order to obtain a measure of the size or lateral extension of the spot size. This may e.g. be performed on targets wherein the configuration or structure of the first region and/or the second region is known. In such case, the image may be deconvolved to extract the spot distribution and size. Further, the total variance in the image may be calculated for a number of focus settings to find the maximum attainable value, which correspond to the sharpest attainable image.

The first region of the target may be combined with the second region in a configuration that facilitates conduction of heat within the target. Preferably, the first region is arranged in thermal contact with the second region such that heat may dissipate from the first region to the second region. The second region may thus be configured to cool the first region, which may get heated due to its interaction with the impinging electrons. The first regions may e.g. be embedded in a matrix of the material of the second region, or provided in a layer arranged on the second region. Advantageous materials for the first region may include tungsten, rhenium, molybdenum, vanadium, niobium and alloys thereof. In general, suitable materials may have an atomic number of 12 or more, or even above 25. Advantageous materials for the second region may e.g. include beryllium, carbon, such as diamond, and other materials of a relatively low atomic number as compared to the material of the first region. It may be desirable to use materials of lower atomic number as compared to the material of the first region in order to reduce the risk of interference of the X-ray spectrums generated by the respective regions. Preferably, the material of the second region may have an atomic number below 15. Alternatively, or additionally the material for the second region may have a relative high thermal conductivity so as to efficiently dissipate heat. Another alternative may be to provide the first and second regions on a common substrate with properties selected so as to efficiently dissipate heat generated by interactions between the electron beam and the target.

The electron source may comprise a cathode that is powered by a voltage supply and includes e.g. a thermionic, thermal-field or cold-field charged-particle source. The electron beam may be accelerated towards an accelerating aperture, at which point it may enter the electron-optical system which may be calibrated and operated to direct the electron beam onto the target in the interaction region. The electron-optical system may comprise an arrangement of aligning means, lenses and deflection means that are controllable by signals provided by the controller. The aligning means, deflection means, and lenses may comprise electrostatic, magnetic, and/or electromagnetic components.

As used herein, the term target or X-ray target may refer to any material or component capable of emitting X-ray radiation upon interaction with impinging electrons. In particular, the target may be a solid target, such as e.g. a sheet, foil or substrate, having at least two distinct regions in terms of their capability of generating X-ray radiation. The target may be formed of a patterned or etched material, wherein the removed portions, defining the pattern or geometrical structures, may form the second regions. The target may be a stationary or a moving target, such as a rotating target. In case of a rotating target, the target may be temporarily stationary during the determination of the width of the electron beam that is scanned between the different regions. Alternatively, or additionally, the target may be moving during the determination of the lateral extension of the electron beam width. In such case, the electron beam spot may be stationary relative an optical axis of the system or move such that the scanning motion of the electron source is caused by the movement of the target. In a further alternative, the scanning motion may be provided by means of a deflection of the electron beam and a movement of the target. Thus, by scanning should be understood the act of traversing the electron beam across a surface of the target—by deflecting the electron beam, moving the target or both.

According to some examples, both regions, i.e., the first region and the second region, may be suitable for use as an X-ray generating target. In other words, both regions may be considered to form part of a target structure and be capable of generating X-ray radiation that can be used for X-ray analysis or other applications utilising X-ray radiation. In this case, a distinction may be made between the first/second region and a target holder, wherein the latter primarily may represent an assembly for providing mechanical support rather than X-ray radiation. Although such a holder may comprise materials that, under certain circumstances, could generate a limited amount of X-ray photons, it would not be considered to represent a structure suitable for generating X-ray radiation. Thus, the first/second region may be construed as a target capable of generating X-ray radiation, rather than a holder for providing mechanical support.

By the term "a quantity indicative of the interaction" should be understood any quantity that is possible to measure or determine, either directly or indirectly, and which comprises information that can be used for determining or characterising the interaction between the electron beam and the target. Examples of such quantities may include an amount of generated X-ray radiation, a number of electrons passing through the target or being absorbed by the target, a number of secondary electrons or electrons being backscattered from the target, heat generated in the target, light emitted from the target, e.g. due to cathodoluminescence, and electric charging of the target. The quantity may also refer to brightness of the generated X-ray radiation. The brightness may e.g. be measured as photons/per steradian per square millimetre at a specific power or normalized per W. Alternatively, or additionally the quantity may relate to the bandwidth of the X-ray radiation, i.e., the flux distribution over the wavelength spectrum.

The term "lateral extension" may refer to the shape, width or area of a cross section of the electron beam, the beam spot, or a two-dimensional projection of the electron beam onto the target. In the context of the present application the term may be interchangeably used with width, spatial distribution or shape of the beam spot. Furthermore, if the lateral extension of the beam spot is determined for a plurality of focus settings a three-dimensional spatial distribution of the electron beam may be estimated.

Further, by interaction between the electron beam and the target is hereby meant the particular way in which matter of the target and the electrons of the electron beam affects one another. Specifically, generation of X-ray radiation is meant.

According to an embodiment, a focus of the electron beam may be varied in the first region and the second region to determine a spatial extension. The beam spot may e.g. be directed onto a first region that is sufficiently small to be covered by the beam spot. By studying the measured quantity as a focus adjusting parameter is scanned or varied between different settings, the spatial extension of the beam spot may be calculated for a particular focus setting. In particular, there may be a significant change in the measured quantity in case the size of the beam spot is decreased below the size of the first region, i.e., if the beam spot is reduced so that it no longer covers the first region. If the size or spatial extension of the first region is known, this can be used for determining the spatial extension of the beam spot.

The quantity indicative of the interaction between the electron beam and the target may be measured by means of a sensing means.

According to an embodiment, the sensing means may comprise an ammeter for measuring the current absorbed by the target. An advantage with this embodiment is that the absorbed current may indicate a measure of the thermal power absorbed by the target. Thus, a control circuit may be implemented to ensure that the target is not thermally overloaded.

According to an embodiment, the electrons scattered off the target, a process known as backscattering, may be measured. This may be achieved by means of a backscattering detector that e.g. may be arranged in front of the target (i.e., an upstream side relative to the electron beam) to not interfere with the trajectory of X-rays. Backscattered electrons may be distributed over a relatively large solid angle (half a sphere) whereas any sensor may collect electrons from some finite part of this solid angle.

According to an embodiment, the amount of generated X-rays may be measured. An advantage with this embodiment is that the size of the X-ray spot may be determined rather than the size of the electron beam spot. Furthermore, the contrast that can be attained between the first and the second region could be expected to be higher when observing the emitted X-ray radiation; a factor of the order five to ten have been observed, as compared to a contrast in the order of a few percent when measuring current (either in the target or backscattered). Measuring the X-ray radiation instead of the current generated in the target allows for the target to be grounded and the X-ray detector or sensor to be arranged external to the housing.

According to an embodiment, an intensity of the electrons may be adjusted based on the determined lateral extension such that a power density supplied to the target is maintained below a predetermined limit. The predetermined limit or threshold may be selected to reduce the risk of local overheating of the target, which may lead to damages such as melting of the target material and generation of debris. Local overheating may be affected by e.g. the spot size and the total current of electrons impinging the target, or, in other words, the power density in terms of impinging electrons per area unit of the target exposed to the beam spot. The power density may therefore be adjusted by varying the energy or intensity of the electron beam, and/or by varying the spot size on the target.

The total power supplied by the electron beam may be measured or given from the electron source and combined with the determined spot size or width so as to calculate the power density within the electron spot, and/or per volume of the target (e.g. measured as $W/m^3$). Once the power density is estimated, the result can be compared to a predetermined threshold value (e.g. stored in a lookup table) and supplied in a feedback loop back to the control circuitry. In one example, the electron-optical means may vary the width of the electron beam, and in another example the energy or power of the electron beam may be adjusted. The power distribution may be used for determining a peak temperature, and thus the vapour pressure, in the target material to reduce the risk for thermally induced damages (caused by e.g. sublimation or melting of the target material).

The X-ray target, including the first and second regions, may comprise locations that differ from each other in terms of e.g. type of material, thermal capacity, thermal conductivity, X-ray generating capability, or structural properties such as thickness of the target material (as seen in the direction of propagation of the electron beam), or edges, grooves, apertures and protrusions that may be present e.g. on or in the surface of the target. Thus, the interaction between the electron beam and the target may depend on the beam spot's specific location on the target.

Moving the beam spot of a specific power density to a location with higher thermal capacity (or higher thermal conductivity) may e.g. result in a lowered temperature at the interaction point, whereas moving said beam spot to a location with poorer heat management capability may lead to a higher temperature at the interaction point. As the determined lateral extension of the electron beam may indicate the power density of the electron beam, this information may be used as an input parameter when directing the electron beam to a specific location of the target, e.g. for maintaining the interaction point below a certain threshold temperature.

Further, different locations on the target may be associated with generation of X-ray radiation of specific wavelengths. Hence, according to an embodiment, the electron beam may be directed to such a specific location so as to generate X-ray radiation comprising a desired energy spectrum.

According to an embodiment, the first region and the second region of the target may be separated by an edge. By scanning the electron beam over the edge, preferably in a direction substantially perpendicular to the edge, the difference in interaction between the electron beam and the target may be measured during the scanning and used for determining a lateral extension of the electron beam (or beam spot). The determination of the lateral extension, such as e.g. the width, may require the scanning speed or the step length (i.e. the distance between consecutive measurements) of the electron beam to be known. This may e.g. be provided or calculated based on the relative position of the target and the electron-optical system and operating parameters of the electron-optical system, or by scanning the electron beam over a structural feature or reference mark having known dimensions. Alternatively, the reference mark may be used for determining a width (or cross-sectional shape).

By the term "edge" should be understood e.g. a line or interface along which two surface regions of the target meet, or a surface step defined by the interface between the first region and the second region of the target. The term may also refer to a transition from a first material, forming the first region, to a second material forming the second region. This transition may in some examples be substantially seamless or smooth.

It will be appreciated that the target may comprise at least two edges extending along different directions on the surface of the target. Alternatively, or additionally, a single edge may extend along more than one direction, i.e., along a curved or bent path. By scanning the electron beam in different directions over the edge(s), the width of the electron beam may be determined in those directions.

According to an embodiment, the first region may have a varying thickness as seen in the direction of propagation of the electron beam. The thickness may vary as a function of different electron energies so as to allow the beam spot to be directed to a location having a thickness that is adapted to the specific electron energy of the electron beam. A relatively thin target material (as compared to e.g. the penetration depth of the impinging electrons) may be used to reduce the scattering of electrons in the target material and hence reduce the X-ray spot size. On the other hand, a relatively thick target material may be used for increasing the intensity of the output X-ray radiation, since a thicker target material tend to increase the interaction with the impinging electrons. In one example, the target may have a minimum thickness close to the electro-optical axis of the system. This is particularly advantageous in systems having an optimal focusing performance on the electro-optical axis.

If a relatively thin target, in relation to the electron penetration depth of the impinging electrons and self-absorption limited X-ray mean-free path, is used a transmission configuration can be used, i.e., a configuration wherein the generated X-rays emanate from the side of the target that is opposite to the side on which the electron beam impacts. Such a configuration, which also may be referred to as a transmission target, is advantageous in that is allows for a shortened distance between the X-ray source and the sample to be irradiated.

Alternatively, the electron source is operated in a reflective mode in which the generated X-rays emanate from the same side of the target as the electron beam impacts on. In the reflective mode a relatively thick target, in relation to the electron penetration depth, may be used. Increasing the thickness of the target advantageously improves the target's capability of withstanding thermal load and reduces the risk of heating induces damages of the target.

A further option may be to take out X-rays perpendicular to the direction of the impacting electron beam to improve accessibility and performance of the system. In case the X-rays exit the system at a direction coinciding with a plane in which the beam spot is located on the target, a linear accumulation of X-rays originating from different locations (depending on the location of the beam spot on the target) may be achieved.

According to an embodiment, the edge may have a polygonal shape, such as a shape conforming to e.g. at least one octagon.

According to an embodiment, the edge may extend along at least three different directions. This allows for the electron beam to be moved over the edge substantially perpendicular to each one of the three different directions to enable determination of a major axis, a minor axis, and an angular orientation of the spot, formed by the electron beam on the target. In particular, such spot may have an elliptic shape described by the major axis, minor axis and the angular orientation.

According to an embodiment, the method may further comprise adjusting, based on the determined major axis, minor axis, and angular orientation of the electron beam spot, at least one of: a spot shape of the electron beam or a spot orientation of the electron beam According to some embodiments, the first region of the X-ray target may be at least partly embedded in the second region. Alternatively, the first region may form part of a layer that is arranged on a substrate, wherein the layer may comprise open regions or holes exposing the underlying substrate. The exposed substrate regions may thus form the second regions of the target.

According to an embodiment the thickness of the second region may be adapted to minimize interaction with the electron beam to avoid excessive heating of the target. In a particular embodiment the first region may be provided as a layer on top of or embedded in a substrate comprising the second region wherein the substrate may be made sufficiently thin so that electrons that penetrate the first region have only a small probability of experiencing any scattering events before exiting the substrate. Thus, electrons having traversed the first region make a comparatively small contribution to the heating of the substrate. To increase the total thermal load the target can withstand the substrate may have a varying thickness; where the part of the substrate directly under the electron beam spot is made thinner than other parts. This embodiment may be advantageous for configurations where the X-rays are taken out at some other angle than along the electron beam since the transmitted electrons will not interfere with the application of the emitted X-rays.

It is noted that the invention relates to all combinations of the technical features outlined above, even if they are recited in mutually different claims.

BRIEF DESCRIPTION OF DRAWINGS

Embodiments of the present invention will now be described with reference to the accompanying drawing, on which.

Figure 1A:
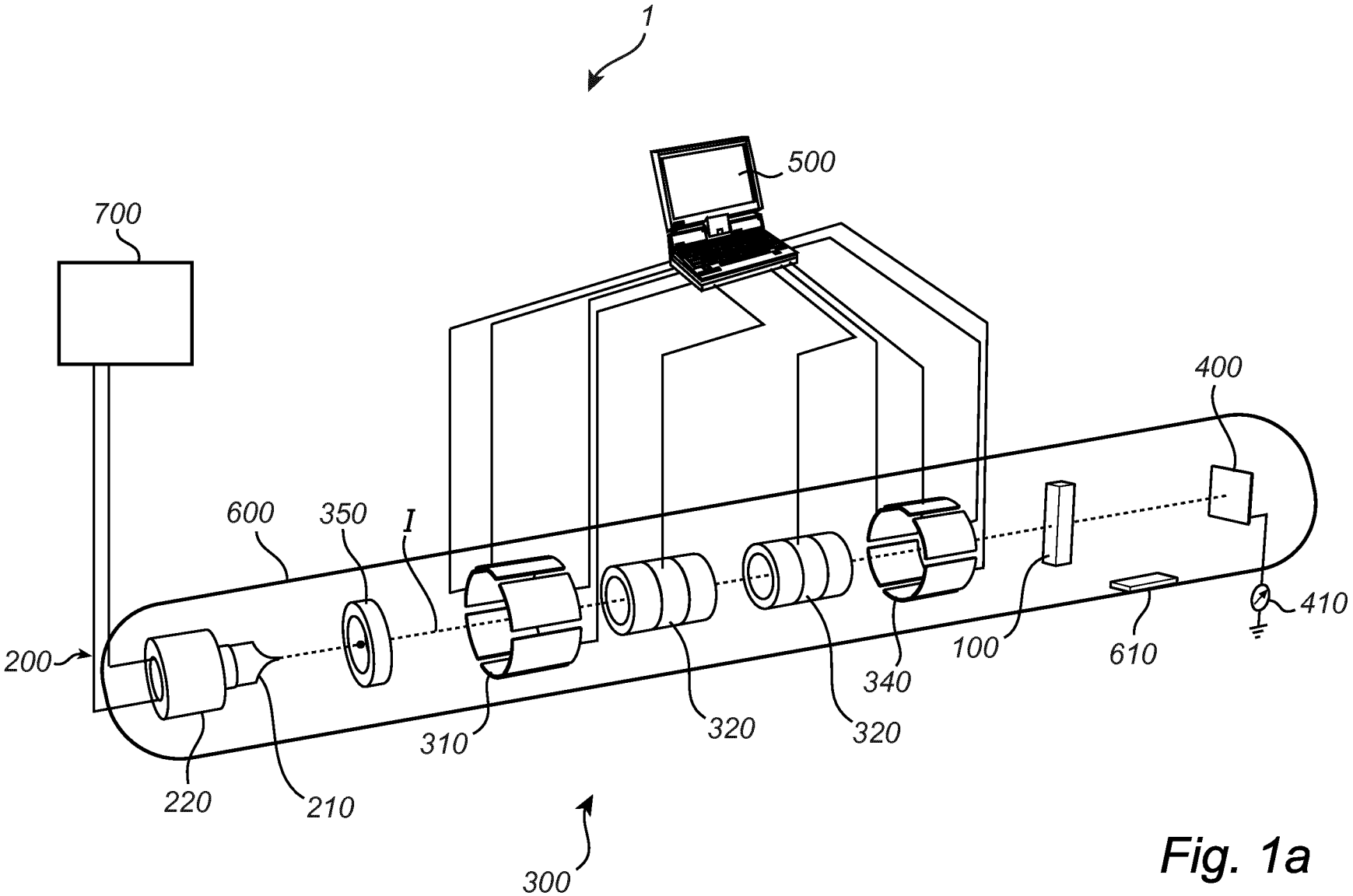
FIG. 1*a* is a perspective view of a system for generating X-ray radiation in accordance with an embodiment of the invention.

Unless otherwise indicated, the drawings are schematic and not to scale.

DETAILED DESCRIPTION OF EMBODIMENTS

FIG. 1 shows a system 1 for generating X-ray radiation, generally comprising an X-ray target 100, an electron source 200 for generating an electron beam I, and a sensor arrangement 400 for measuring a quantity Q indicative of the interaction between the electron beam I and the target 100. This equipment may be located inside a housing 600, with possible exceptions for a voltage supply 700 and a controller 500, which may be located outside the housing 600 as shown in the drawing. Various electron-optical means 300 functioning by electromagnetic interaction may also be provided for controlling and deflecting the electron beam I.

The electron source 200 generally comprises a cathode 210 which is powered by the voltage supply 700 and includes an electron source 220, e.g., a thermionic, thermal-field or cold-field charged-particle source. An electron beam I from the electron source 200 may be accelerated towards an accelerating aperture 350, at which point the beam I enters the electron-optical means 300 which may comprise an arrangement of aligning plates 310, lenses 320 and an arrangement of deflection plates 340. Variable properties of the aligning means 310, deflection means 340 and lenses 320 may be controllable by signals provided by the controller 500. In this embodiment, the deflection and aligning means 340, 310 are operable to accelerate the electron beam I in at least two transversal directions.

Downstream of the electron-optical means 300, the outgoing electron beam I may intersect with the X-ray target 100, which will be described in further detail below. This is where the X-ray production takes place, and the location may also be referred to as the interaction region or interaction point. X-rays may be led out from the housing 600, via e.g. an X-ray window 610, in a direction not coinciding with the electron beam I.

According to the present embodiment, a portion of the electron beam I may continue past the interaction region and reach the sensor 400. The sensor may e.g. be a conductive plate connected to ground via an ammeter 410, which provides an approximate measure of the total current carried by the electron beam I downstream of the target 100. It is understood that the controller 500 has access to the actual signal from the ammeter 410.

Figure 1B:
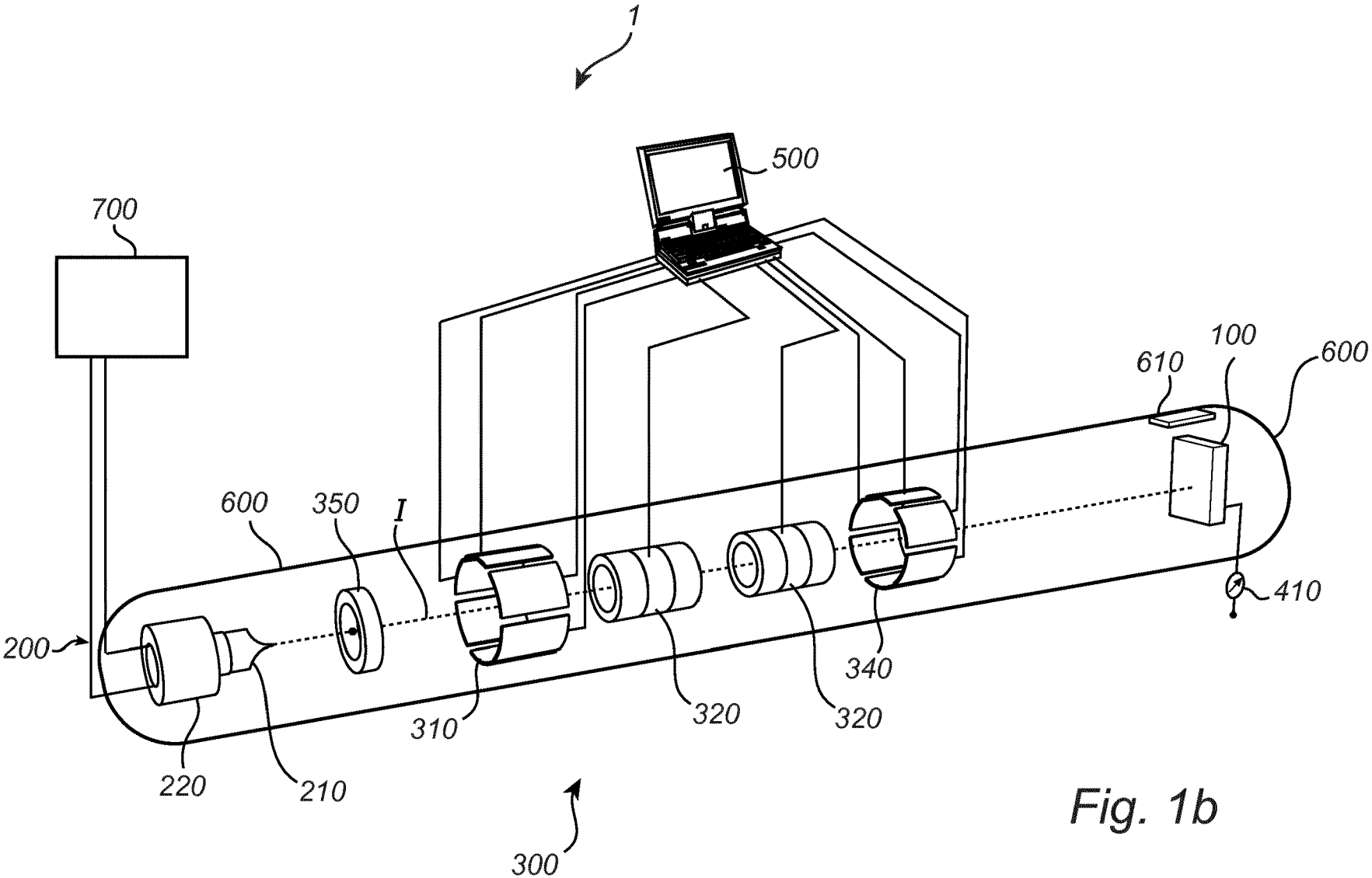
FIGS. 1*b* and 1*c* show alternative implementations of the system shown in FIG. 1*a;*

FIG. 1*b* shows another embodiment, largely similar to that shown in FIG. 1*a*, but in which the sensor 400 and the target 100 are differently implemented. In this embodiment, there is no separate sensor arrangement. Rather, the ammeter 410 is used for determining the amount of charge absorbed by the target 100 and is thus directly connected to the target.

Figure 1C:
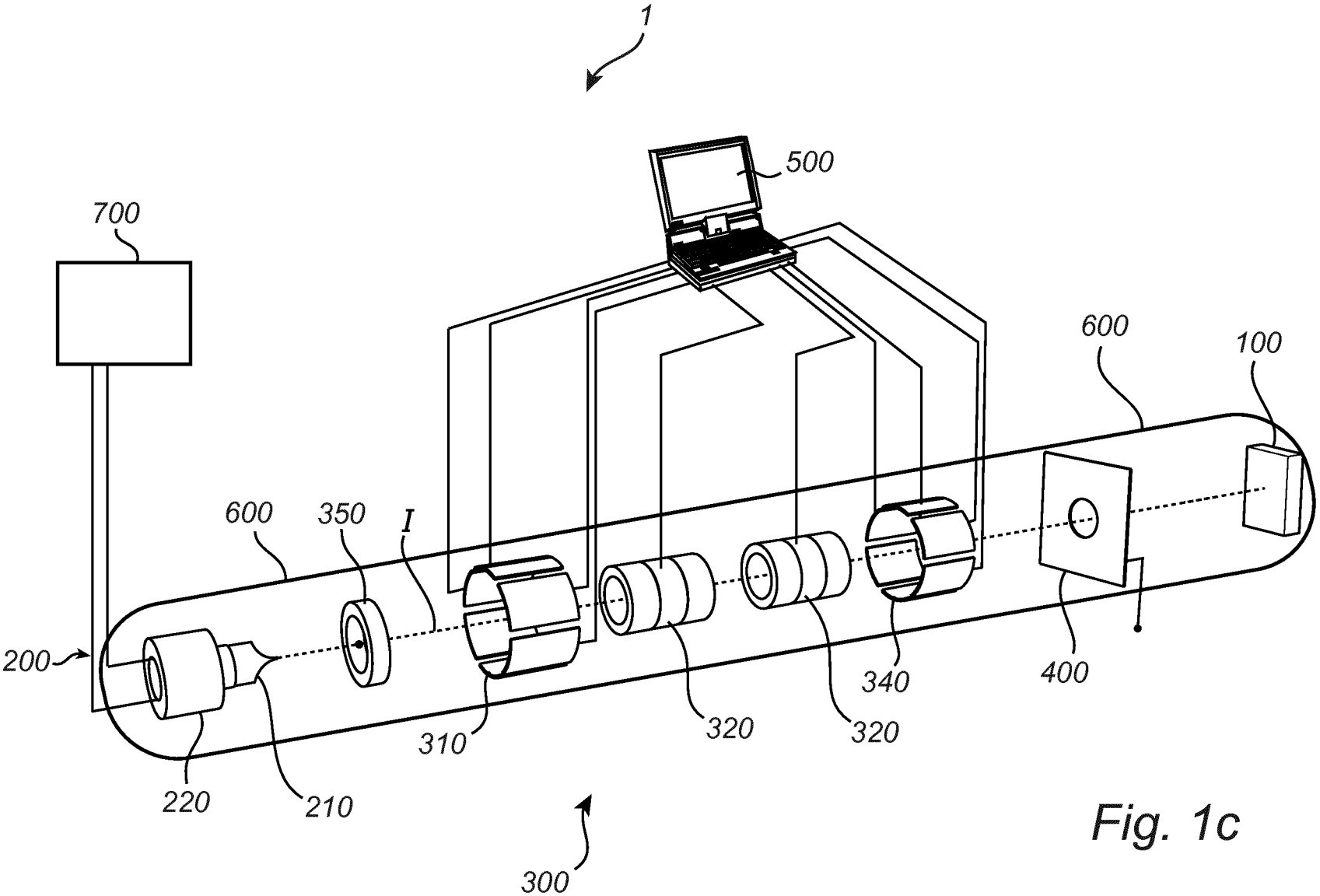

FIG. 1*c* shows a further embodiment of the invention, also this largely similar to that shown in FIG. 1*a*, but in which a backscattering sensor 400 is arranged upstream of the interaction region. The backscattering sensor 400 may e.g. comprise an electrically conducting plate or grid connected to an ammeter (not shown) to provide an approximate measure of the amount of electrons that are backscattered from the target 100. As indicated in the present figure, the system 1 may be operated in a transmission configuration, wherein the generated X-rays emanate from the side of the target 100 that is opposite to the side on which the electron beam I impacts. In case the target 100 is arranged at, or even incorporated with, the housing 600, the X-ray window 610 shown in FIGS. 1*a* and *b* may be omitted and the generated X-rays exiting the housing 600 directly through the target 100.

The above embodiments are merely examples of possible implementations of sensors adapted to measure a quantity Q indicative of the interaction between the electron beam I and the X-ray target 100. As shown in those examples, the quantity Q may refer to the number of electrons that passes through the target, the number of electrons that are absorbed in (or charge) the target, and the number of electrons that are backscattered from the target. Other quantities are however conceivable, and may e.g. relate to the local heating of the target, the amount of generated X-rays, the amount of generated visible light, and the energy of the electrons that are not absorbed by the target.

Figure 2A:
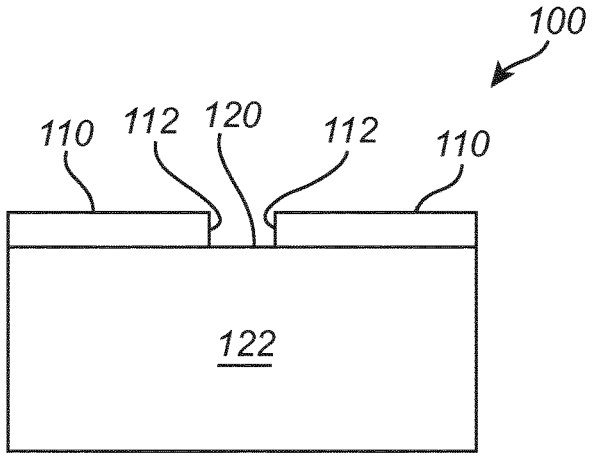
FIG. 2*a* is a cross section of an X-ray target according to an embodiment of the invention.

FIG. 2*a* shows a cross sectional portion of an X-ray target according to an embodiment of the invention. The target 100 comprises a first region 110 and a second region 120, wherein the interface between the first region 110 and the second region 120 forms an edge or step 112. The first region 110 may be formed of a material capable of generating X-rays upon interaction with impinging electrons, and may e.g. include such a dense material like tungsten. The tungsten region 110 may be provided in a layer that may be evaporated onto a substrate 122. The layer may e.g. be about 500 nm thick and provided with apertures, such as square, octagon, or circle shaped holes, exposing the underlying substrate 122. The apertures may e.g. be formed by means of photo lithography and etching. The substrate may be formed of a material that compared to the material of the first region 110 is more transparent to impinging electrons, and may e.g. be about 100 micrometers thick. The substrate may e.g. comprise diamond or similar light material with low atomic number and preferably high thermal conductivity.

As illustrated in FIG. 2*a*, the tungsten layer 110 may comprise an aperture or open region exposing the underlying diamond substrate 122, thereby forming the second region 120 of the target 100.

Figure 2B:
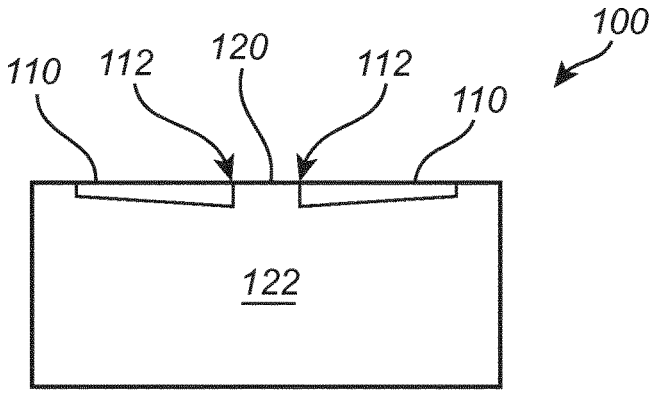
FIG. 2*b* shows an alternative implementation of a target of the type shown in FIG. 2*a;*

FIG. 2*b* shows another embodiment of a target that may be similarly configured as the one in FIG. 2*a*, but in which the first regions 110 are at least partly embedded in the substrate 122 and have a thickness, in the direction of propagation of the electron beam, that varies along the surface of the target 100. Alternatively, a first region 110 may have a constant thickness that differs from other first regions 110.

Figure 2C:
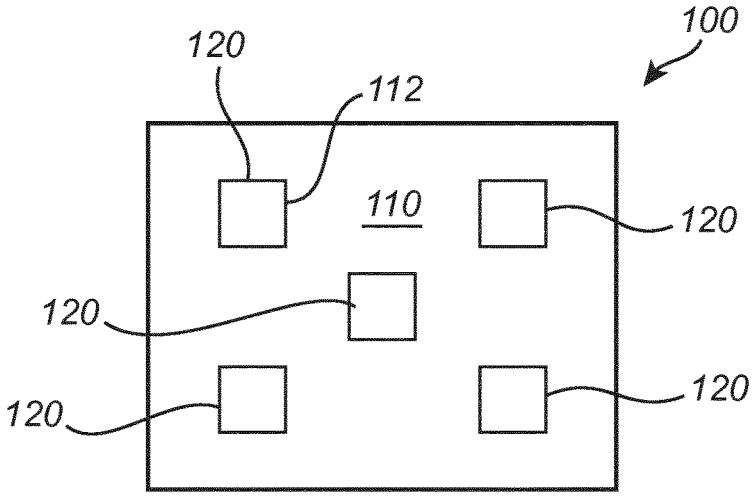
FIG. 2*c-e* show top views of targets similar to the types shown in FIGS. 2*a* and *b;*

FIG. 2*c* is a top view of a target 100 similar to the ones of FIGS. 2*a* and 2*b*. In this embodiment, the second regions 120 are formed as five rectangles or squares having edges 112 that extend in two substantially perpendicular directions.

Figure 2D:
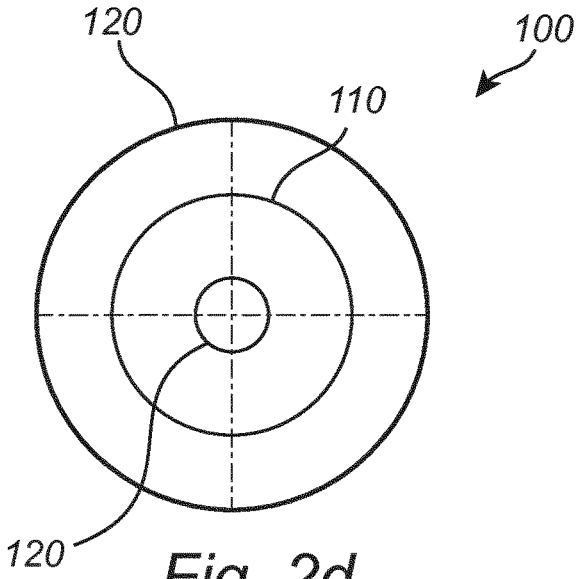

FIG. 2*d* is a top view of similar target 100 as in FIGS. 2*a-c*, wherein the first region 110 is formed as a circle that is enclosed by a second region 120. A second region 120 may also be arranged within the first region 110, forming a circular edge between the different regions 110, 120. The circular edge allows for the lateral extension of the beam spot to be determined in any direction.

Figure 2E:
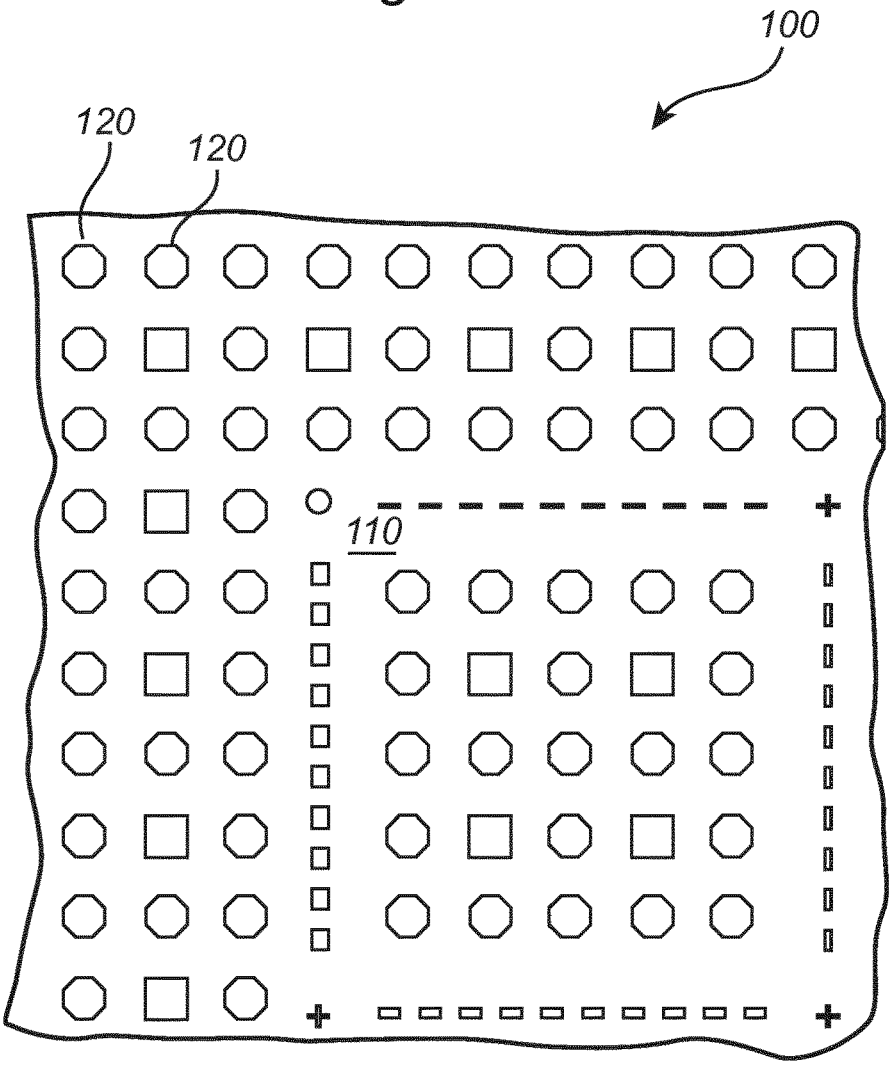

FIG. 2*e* shows a portion of a target 100, comprising a plurality of first regions 110 shaped as octagons, squares and rectangles. The octagons may be used for measuring the size of the beam spot in at least three directions, such as 0°, 45° and 90°, thereby allowing for ellipticity of the beam spot (and hence astigmatic effects) to be estimated. By measuring along three directions the length of the major and minor axes as well as the angular orientation of an elliptic spot may be determined. This estimated information may e.g. be used for calibration of the electron optics along these three directions. It might for example be advantageous to orient the major axis of an elliptic spot in a particular direction or alternatively it may be advantageous to obtain a circular spot. Thus one way of using the estimated information is to adjust the electron optics to obtain a desired beam spot.

Figure 3A:
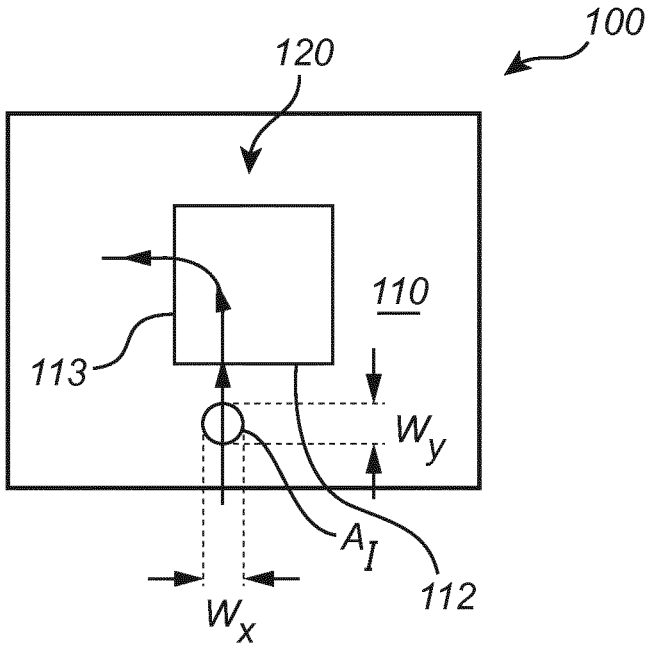
FIG. 3*a* shows, in the plane of scanning, a location of an electron beam being scanned over a first and a second region of a target in accordance with an embodiment of the invention.

FIG. 3*a* shows, in the plane of scanning, a location of an electron beam spot $A_I$ that is traversed across a surface of a target 100 in the direction indicated by the arrow. The target may be similarly configured as the targets discussed in connection with FIGS. 2*a-e*. The beam spot $A_I$, which may have a width $W_x$ in a first direction and $W_y$ in a second direction, may be scanned from a first region 110 of the target, over a first edge 112 between the first region 110 and the second region 120 towards the second region 120 of the target 100. Further, the beam spot $A_I$ may continue over the second region 120 towards a second edge 113, perpendicular to the first edge 112, at which the beam spot $A_I$ enters the first region 110 again. The scanning motion may be controlled by the controller and the electron-optical means (not shown).

Since the material of the first region 110 and the second region 120 generally interact differently with impinging electrons—tungsten, which may form the first region 110, tends to generate X-rays whereas diamond, which may form the second region 120, tends to have a lower X-ray generating capability—the location of the electron beam spot may be determined by observing its interaction with the target 100. The interaction may e.g. be monitored by measuring a quantity Q such as the amount of generated X-ray radiation, or by measuring a number of electrons that pass through the target 100 or backscatter.

Figure 3B:
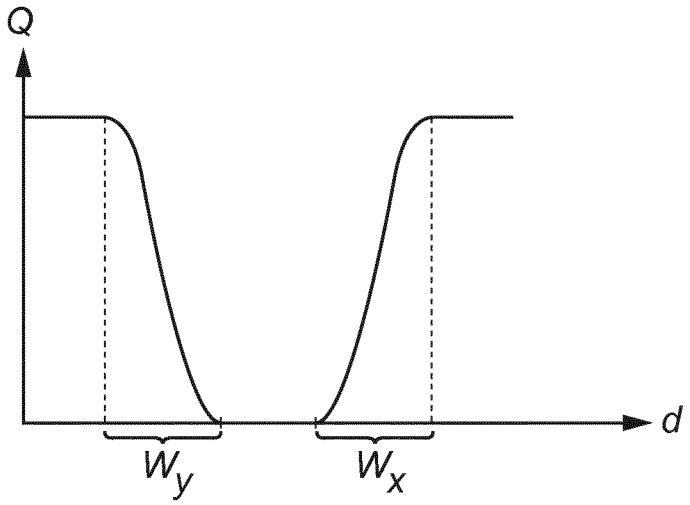
FIG. 3*b* shows a plot of a sensor signal against different positions of the electron beam on the target.

The resulting quantity Q is shown in FIG. 3*b*, which shows a plot of a sensor signal indicating the measured quantity Q as a function of the traveled distance d on the surface of the target 100 for backscattered electrons or generated X-rays. The traveled distance d, or position on the surface of the target 100, may e.g. be determined by the particular deflector settings used for deflecting the electron beam. In the present example, the rate of change in the sensor signal (e.g. indicating the amount of X-ray radiation generated at different locations on the target) from a first, relatively constant level to a reduced or near-zero sensor signal is proportional to a first width $W_y$ of the beam spot $A_I$. As the beam spot $A_I$ then crosses the second edge 113, in a direction perpendicular to the first edge 112, the rate of increase in sensor signal is proportional to a second width $W_x$ of the beam spot $A_I$.

A similar procedure may be used for determining the correlation between the settings of the electron-optical means, such as the deflector, and the position of the electron beam relative to the target. This may be done by observing the sensor signal, as described above, for different settings of the electron-optical means and correlate the settings with the electron beam passing over the edges 112, 113 of the target 100.

The person skilled in the art by no means is limited to the example embodiments described above. On the contrary, many modifications and variations are possible within the scope of the appended claims. In particular, X-ray sources and systems comprising more than one electron beam are conceivable within the scope of the present inventive concept. Furthermore, X-ray sources of the type described herein may advantageously be combined with X-ray optics tailored to specific applications (many examples of this are well known within the field of X-ray technology). In particular, the ability to deflect the electron beam to different locations on the target may be used to align the X-ray source with the optics. Additionally, variation to the disclosed embodiments can be understood and effected by the skilled person in practising the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A method in a system comprising:

an electron source operable to generate an electron beam; and a stationary X-ray target for generating X-ray radiation upon interaction with the electron beam, the target comprising a first target region and a second target region; wherein:

the first target region and the second target region have different capability to generate X-ray radiation;

the first target region and the second target region are separated by a first interface and a second interface oriented at an angle relative each other;

each of the first target region and the second target region has a size allowing it to accommodate an entire cross section of the electron beam; and the first target region and the second target region are arranged on a common substrate;

the method comprising:

moving the electron beam in a first direction over the first interface and into the second target region, such that the entire cross section of the electron beam is arranged within the second target region; followed by moving the electron beam in a second direction over the second target region, over the second interface and into the first target region, such that the entire cross section of the electron beam is arranged within the first target region;

the method further comprising:

measuring, as the electron beam is moved over the first interface, a change in a quantity indicative of the interaction between the electron beam and the first target region and between the electron beam and the second target region;

measuring, as the electron beam is moved over the second interface, a change in the quantity indicative of the interaction between the electron beam and the second target region and between the electron beam and the first target region; and determining a width of the electron beam along the first direction and the second direction, respectively, based on the measured change in the quantity and the movement of the electron beam, wherein said first direction is substantially perpendicular to said first interface and said second direction is substantially perpendicular to said second interface.

2. The method according to claim 1, wherein the quantity is at least one of: an amount of X-ray radiation, an amount of secondary electrons or backscattered electrons, and an amount of electrons absorbed in the target.

3. The method according to claim 1, wherein said first interface is substantially perpendicular to said second interface.

4. The method according to claim 1, comprising varying a focus of the electron beam in the first target region and the second target region.

5. The method according to claim 1, further comprising adjusting, based on the determined width, at least one of: an intensity of the electron beam such that a power density supplied to the target is maintained below a predetermined limit, and a spot size of the electron beam.

6. The method according to claim 1, further comprising directing the electron beam to a specific location on the target based on at least one of: the determined width, and a desired wavelength of the X-ray radiation.

7. The method according to claim 1, wherein the first interface and/or the second interface comprises a surface step of the X-ray target.

8. The method according to claim 1, further comprising:

moving the electron beam in a third direction over a third interface separating the first target region from the second target region wherein the first direction, second direction, and third direction are different;

measuring a change in the quantity indicative of the interaction between the electron beam and the second target region and between the electron beam and the first target region as the electron is being moved over the third interface; and determining, based on the measured change in the quantity and the movement of the electron beam, a major axis, a minor axis, and an angular orientation of an electron beam spot having an elliptic shape.

9. The method according to claim 8, further comprising adjusting, based on the determined major axis, minor axis, and angular orientation of the electron beam spot, at least one of: a spot shape of the electron beam or a spot orientation of the electron beam.

10. A system adapted to generate X-ray radiation, comprising:

an electron source operable to generate an electron beam;

a stationary X-ray target for generating X-ray radiation upon interaction with the electron beam, comprising a first target region and a second target region, wherein the first target region and the second target region have different capability to generate X-ray radiation and are separated by a first interface and a second interface oriented at an angle relative each other, wherein each of the first target region and the second target region has a size allowing it to accommodate an entire cross section of the electron beam, and wherein the first target region and the second target region are arranged on a common substrate;

an electron-optical means for moving the electron beam in a first direction over the first interface and into the second target region, such that the entire cross section of the electron beam is arranged within the second target region, and then moving the electron beam in a second direction over the second target region, over the second interface and into the first target region, such that the entire cross section of the electron beam is arranged within the first target region;

a sensor adapted to measure, as the electron beam is moved over the first interface, a change in a quantity indicative of the interaction between the electron beam and the first target region and between the electron beam and the second target region, and to measure, as the electron beam is moved over the second interface, a change in the quantity indicative of the interaction between the electron beam and the second target region and between the electron beam and the first target region; and a controller operably connected to the sensor and the electron-optical means and adapted to determine a width of the electron beam along the first direction and the second direction, respectively, based on the measured change in the quantity and the movement of the electron beam, wherein said first direction is substantially perpendicular to said first interface and said second direction is substantially perpendicular to said second interface.

11. The system according to claim 10, wherein the first target region has a varying thickness as seen in the direction of propagation of the electron beam.

12. The system according to claim 10, wherein the first target region of the X-ray target forms part of a layer and the second target region forms part of the substrate, and wherein the layer is arranged on the substrate.

13. The system according to claim 10, wherein the first target region is at least partly embedded in the second target region.

14. The system according to claim 10, wherein the first target region and the second target region are formed of different materials, the second target region comprising a material having at least one of: a higher transparency to the electron beam and X-ray radiation as compared to the first target region, and an atomic number that is lower than an atomic number of a material of the first target region.

15. The system according to claim 10, wherein the first target region comprises a material selected from a list including tungsten, rhenium, molybdenum, vanadium, and niobium, and wherein the second target region comprises beryllium or carbon, such as diamond.

16. The system according to claim 10, wherein the first target region and the second target region are separated by a plurality of interfaces forming a shape conforming to at least one octagon.

17. A system adapted to generate X-ray radiation, comprising:

an electron source operable to generate an electron beam;

a stationary X-ray target for generating X-ray radiation upon interaction with the electron beam, comprising a first target region and a second target region, wherein the first target region and the second target region are separated by a first interface and a second interface oriented at an angle relative each other, wherein each of the first target region and the second target region has a size allowing it to accommodate an entire cross section of the electron beam, and wherein the first target region and the second target region are arranged on a common substrate;

an electron-optical means for moving the electron beam in a first direction over the first interface and into the second target region, such that the entire cross section of the electron beam is arranged within the second target region, and then moving the electron beam in a second direction over the second target region, over the second interface and into the first target region, such that the entire cross section of the electron beam is arranged within the first target region;

a sensor adapted to measure, as the electron beam is moved over the first interface, a change in a quantity indicative of the interaction between the electron beam and the first target region and between the electron beam and the second target region, and to measure, as the electron beam is moved over the second interface, a change in the quantity indicative of the interaction between the electron beam and the second target region and between the electron beam and the first target region; and a controller operably connected to the sensor and the electron-optical means and adapted to determine a width of the electron beam along the first direction and the second direction, respectively, based on the measured change in the quantity and the movement of the electron beam;

wherein:

the first target region and the second target region of the X-ray target are arranged to provide a contrast of at least two percent in said quantity; and said first direction is substantially perpendicular to said first interface and said second direction is substantially perpendicular to said second interface.

* * * * *